United States Patent [19]

Van Scoy-Mosher

[11] Patent Number: 4,837,863

[45] Date of Patent: Jun. 13, 1989

[54] HOSPITAL GOWN

[76] Inventor: Cheryle Van Scoy-Mosher, 256 Rafael Walk, Long Beach, Calif. 90803

[21] Appl. No.: 175,867

[22] Filed: Mar. 31, 1988

[51] Int. Cl.[4] ..... A41D 10/00

[52] U.S. Cl. ..... 2/114; 2/DIG. 7

[58] Field of Search ..... 2/113, 114, 115, 243 B, 2/DIG. 7

[56] References Cited

U.S. PATENT DOCUMENTS

| | | | |
|---|---|---|---|
| Re. 27,348 | 5/1972 | Bradley | 2/114 |
| 1,462,515 | 7/1923 | McElroy | 2/DIG. 7 X |
| 1,489,046 | 4/1924 | Thompson | 2/114 X |
| 2,692,989 | 11/1954 | Jelstrup | 2/114 |
| 2,701,364 | 2/1955 | Palm | 2/114 |
| 2,736,900 | 3/1956 | Koren | 2/DIG. 7 X |
| 2,768,383 | 10/1956 | De Witt | 2/DIG. 7 X |
| 2,807,022 | 9/1957 | Bonanni | 2/114 |
| 2,818,573 | 1/1958 | O'Donnell | 2/114 |
| 3,129,432 | 4/1964 | Belkin | 2/DIG. 7 X |
| 3,259,913 | 7/1966 | Tames | 2/DIG. 7 X |
| 3,359,569 | 12/1967 | Rotanz et al. | 2/114 |
| 3,570,012 | 3/1971 | Winters | 2/114 |
| 4,422,186 | 12/1983 | Loney | 2/114 |
| 4,434,511 | 3/1984 | Weiser | 2/114 |
| 4,570,268 | 2/1986 | Freeman | 2/114 |
| 4,674,130 | 6/1987 | Coudron | 2/114 X |
| 4,686,715 | 8/1987 | Price | 2/114 |

*Primary Examiner*—Werner H. Schroeder
*Assistant Examiner*—Jeanette E. Chapman
*Attorney, Agent, or Firm*—Blakely, Sokoloff, Taylor, Zafman

[57] ABSTRACT

An improved patient's hospital gown comprises a body portion having a front panel and overlapping inner and outer back panels. The back panels overlap for a substantial portion of their respective widths. The front panel is joined to the two back panels along each side by a series of spaced apart fasteners. In a first embodiment, a yoke portion is attached to the body portion of the gown and is closed around the neck of the patient when the overlapping back panels are each secured with fasteners to the respective opposite sides of the yoke portion. In a second embodiment, the yoke portion comprises a contiguous piece of fabric that is put on over the patient's head, thereby preventing the gown from falling off of the patient's shoulders when the back panels are unfastened.

14 Claims, 3 Drawing Sheets

HOSPITAL GOWN

FIELD OF THE INVENTION

This invention relates to a patient's hospital gown and, particularly, to a gown affording the patient a more stylish and discrete garment than a conventional hospital gown while permitting ready access to the patient's body for purposes of examination and/or treatment.

BACKGROUND ART

Conventional hospital gowns typically consist of a body portion joined, usually at the patient's back, by a series of tie straps. While such gowns are inexpensive and provide convenient access to the patient's body for performing procedures, they are awkward to put on and generally do not provide adequate coverage where the gown closes. For these latter reasons, conventional hospital gowns are widely viewed with disfavor by the patients who must wear them.

A number of improved hospital gowns have been proposed that address certain of the shortcomings of conventional gowns. For example, U.S. Pat. No. 4,570,268 issued on Feb. 18, 1986 to Freeman discloses a patient's garment having hook and loop type fasteners and having an overlap of material along the closure of the garment. Freeman also discloses sleeves provided with an openable seam along each arm to provide improved access to portions of the patient's body without having to open the principal closure of the garment.

Further improvements to conventional hospital gowns are disclosed in U.S. Pat. No. 4,718,124 issued on Jan. 12, 1988 to Sawicki et al. The gown of Sawicki et al is generally similar to that of Freeman, but incorporates various means for securing medical devices, such as telemetry units and drainage bag, to the gown itself.

None of the gowns disclosed by the prior art employ a substantial overlap of material in order to preclude unintended exposure of the patient's body. Furthermore, prior art gowns do not incorporate an openable seam along the entire side portion of the gown to provide improved access to the patient's body.

These and other improvements over prior art hospital gowns are incorporated in the present invention as will be subsequently described.

SUMMARY OF THE INVENTION

The present invention provides an improved hospital gown comprising a body portion having a front panel and overlapping inner and outer back panels. The back panels overlap for a substantial portion of their respective widths. The front panel is preferably joined to the two back panels along each side by a series of spaced apart fasteners.

In a first embodiment, the body portion of the gown includes a yoke portion which is closed around the neck of the patient when the overlapping back panels are each secured with fasteners to the respective opposite sides of the yoke portion.

In a second embodiment, the yoke portion comprises a contiguous piece of fabric that is put on over the patient's head. In this second embodiment, the contiguous yoke portion prevents the gown from falling off of the patient's shoulders when the back panels are unfastened.

BRIEF DESCRIPTIONS OF THE DRAWINGS

DETAILED DESCRIPTION OF THE PREFERRED EMBODIMENTS

Figure 1:
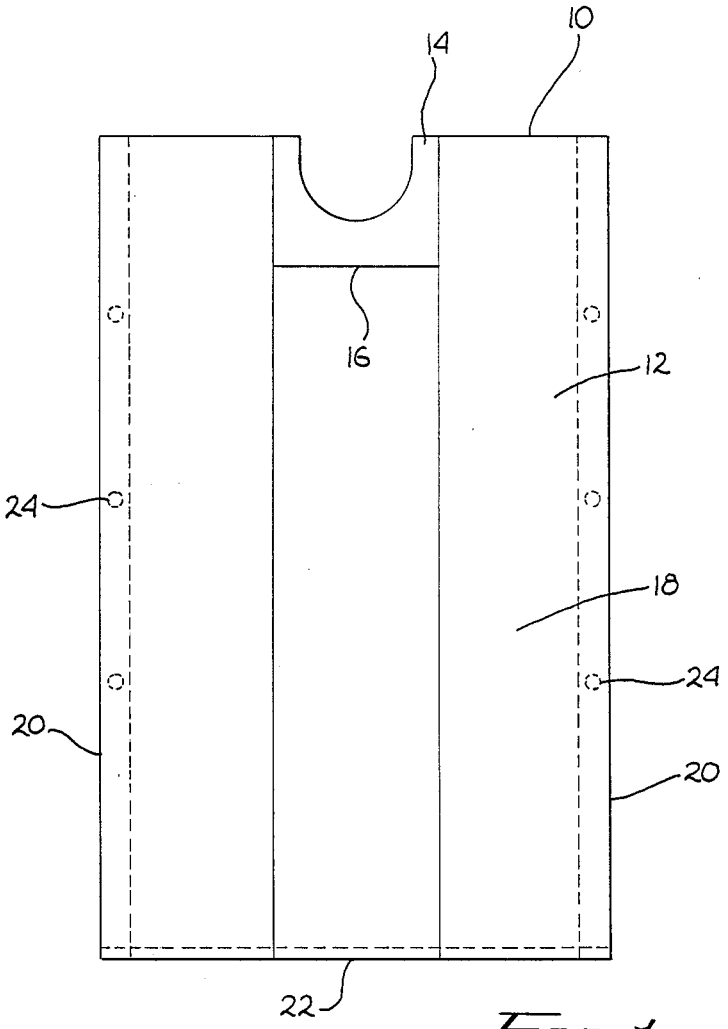
FIG. 1 is a front elevation view of a gown according to a first embodiment of the present invention.
Figure 2:
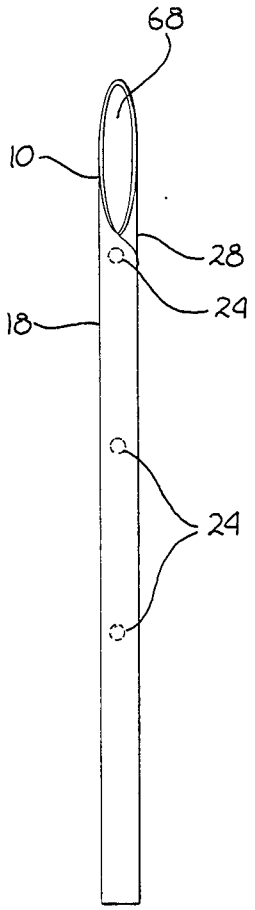
FIG. 2 is a side elevation view of the gown shown in FIG. 1.
Figure 3:
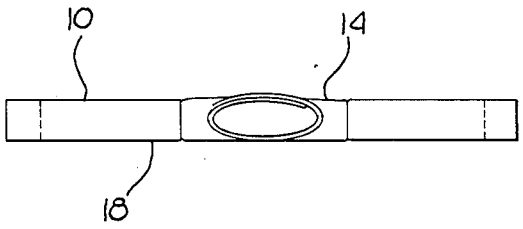
FIG. 3 is a top view of the gown shown in FIG. 1.

An improved hospital gown is disclosed. In the following description, for purposes of explanation and not limitation, specific details of construction, such as configurations of fabric panels and seams, are set forth in order to provide a thorough understanding of the present invention. However, it will be apparent to one skilled in the art that the present invention may be practiced without these specific details.

Referring to FIGS. 1–7, a first embodiment of a gown 10 according to the present invention is shown. Gown 10, which may be constructed of any suitable fabric, includes body portion 12. Yoke portion 14 is attached to body portion 12 by means such as seam 16. Body portion 12 includes front panel 18 having side edges 20 and hem 22. Fasteners, such as snaps 24, are positioned at intervals along side edges 20.

Figure 4:
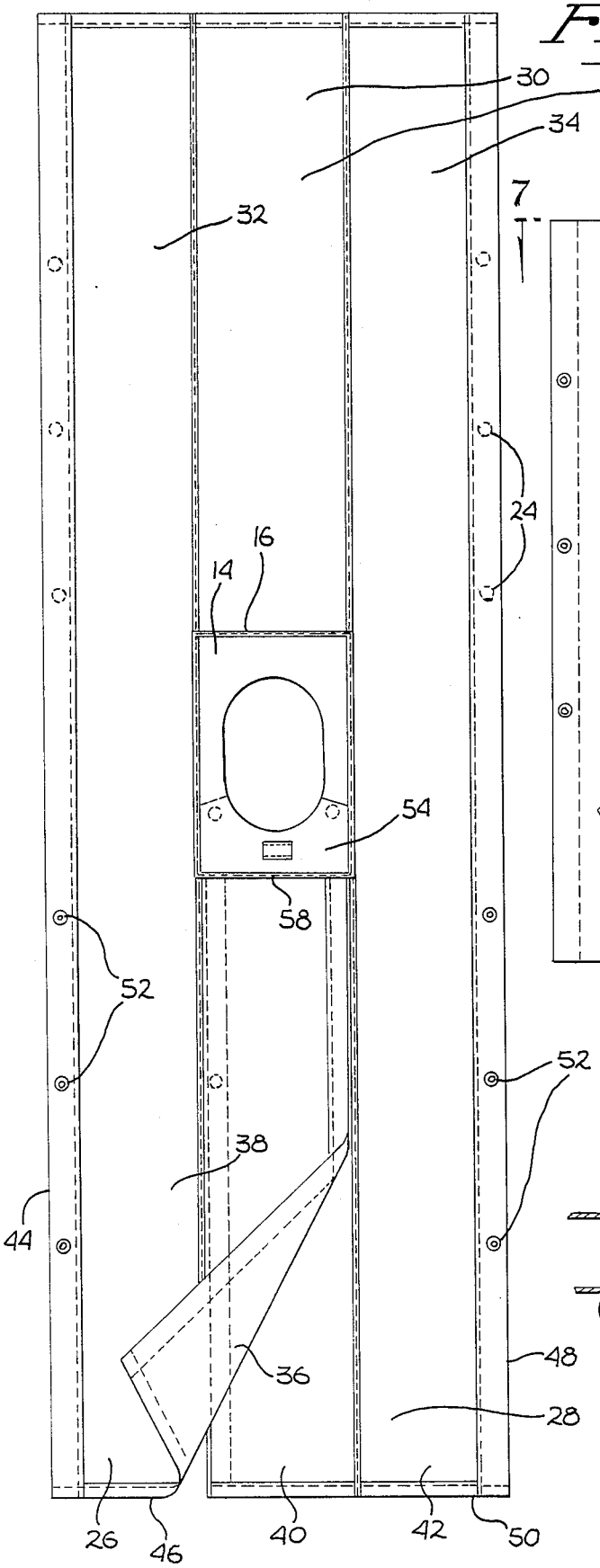
FIG. 4 is a plan view showing the interior surfaces of the gown shown in FIG. 1 laid flat.
Figure 5:
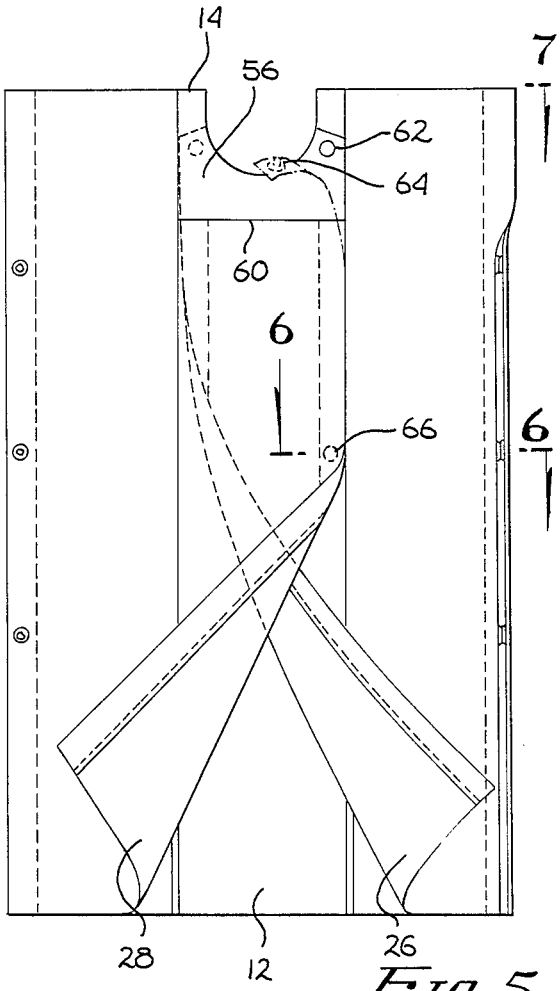
FIG. 5 is a rear elevation view of the gown shown in FIG. 1.

As best seen in FIG. 4, body portion 12 of gown 10 also includes inner back panel 26 and outer back panel 28. In the illustrated embodiment, front panel 18 comprises center panel 30 and side panels 32 and 34. Inner back panel 26 comprises center panel 36 and side panel 38, and outer back panel 28 comprises center panel 40 and side panel 42.

As illustrated, body portion 12 is substantially rectangular in shape for ease of manufacture. Side panels 32 and 38 comprise a unitary piece of fabric, as do side panels 34 and 42. However, it will be appreciated by those skilled in the art that panels 18, 26 and 28 may be partitioned and seamed in numerous other ways for convenience of manufacture and/or embellishment. For example, yoke portion 14 may be integrated with body portion 12 rather than being attached as a separate panel or one or both of back panels 26 and 28 may be sewn to front panel 18. Accordingly, the present invention is not to be construed as limited to the particular arrangement of panels described herein.

Figure 6:
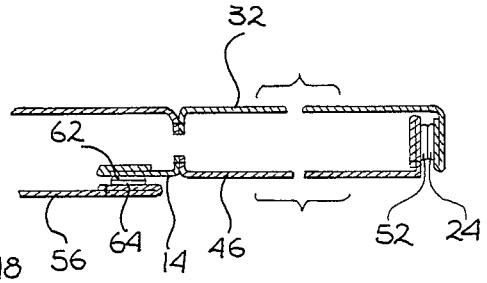
FIG. 6 is a partial cross-sectional view taken along line 6-6 of FIG. 5.
Figure 7:
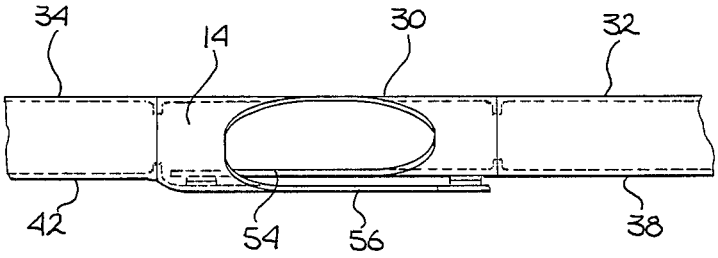
FIG. 7 is an enlarged partial top view of the gown shown in FIG. 1.

Inner back panel 26 has side edge 44 and hem 46. Outer back panel 28 has side edge 48 and hem 50. Fasteners, such as snaps 52, are positioned at intervals along side edges 44 and 48 for mating engagement with snaps 24 on front panel 18 when side edges 20, 44 and 48 are folded inwardly as shown in FIG. 6. Although the illustrated embodiment uses snaps 24, 52, other suitable fasteners, such as hook and loop type fasteners, may also be employed.

Yoke portion 14 includes overlapping inner and outer shoulder panels 54 and 56, respectively. Inner shoulder panel 54 is secured to center panel 36 of inner back panel 26 at seam 58. In like manner, outer shoulder panel 56 is secured to center panel 40 of outer back panel 28 at seam 60. Fasteners, such as snaps 62, 64 allow yoke portion 14 to be secured around the neck of a patient.

Gown 10 is worn by placing yoke portion 14 around the patient's neck and securing snaps 62, 64 as described above. Additional snaps or other suitable fasteners may be added along back center panels 36 and 40, such as shown at 66, in order to secure the back vent. It will be appreciated, however, that the substantial overlap of inner and outer back panels 26 and 28 insures that the gown remains closed even without additional snaps as at 66.

The sides of gown 10 may be secured by fastening means, such as snaps 24 along side edges 20 and mating snaps 52 along side edges 44 and 48. In some cases, such as when ease of access to the patient's body is not required, side edges 20 may be sewn to side edges 44 and 48.

It should be noted that the illustrated embodiments of the present invention do not require contouring of the fabric panels or separate panels to form sleeves for the patient's arms. The width of body panel 12 is sufficient that it will drape over the upper portion of the patient's arms. Side edges 20 are secured to side edges 44 and 48 so as to permit the patient's arms to extend through openings 68.

Since gown 10 may be opened in the back and at either side, it affords convenient access to the patient's body for localized examination and/or treatment without the need to completely disrobe. Although the panels of gown 10 have been described as "front" or "back" for purposes of convenience, it is to be understood that gown 10 is generally symmetrical and can be worn with "front" panel 18 either at the patient's front or back as dictated by medical requirements or the patient's preference.

Figure 8:
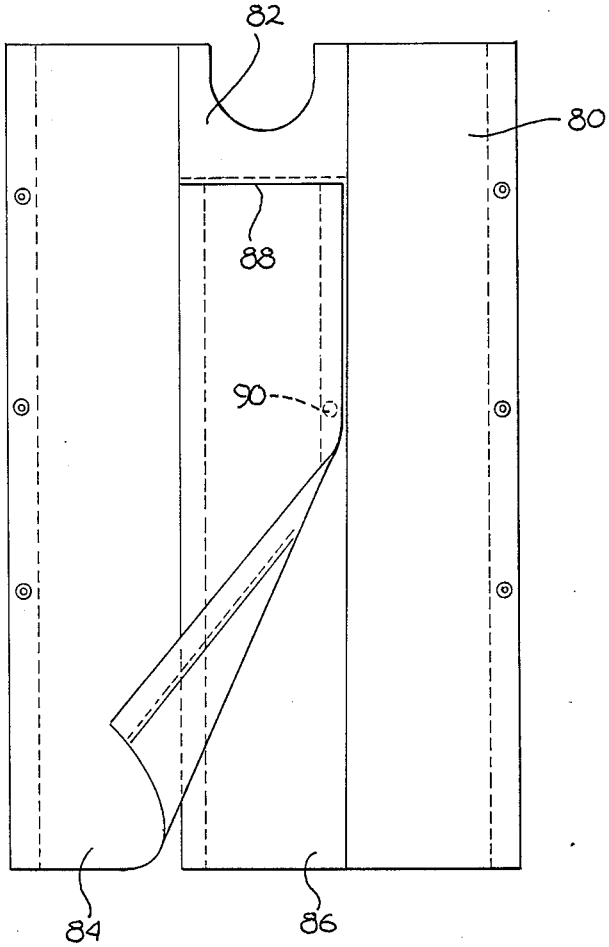
FIG. 8 is a rear elevation view of a gown according to a second embodiment of the present invention.

A second embodiment of the present invention is illustrated in FIG. 8. In this embodiment, gown 80 is essentially the same as gown 10 described above except that yoke portion 82 comprises a contiguous piece of fabric encircling the patient's neck. Back panels 84 and 86 are sewn to yoke portion 82 at seam 88 and are secured to one another by a suitable fastener such as at 90. This embodiment, which is put on over the patient's head, offers the advantage that gown 80 is prevented from falling off of the patient's shoulders during examination or treatment.

It will be recognized that the above described invention may be embodied in other specific forms without departing from the spirit or essential characteristics of the disclosure. Thus, it is understood that the invention is not to be limited by the foregoing illustrative details except as set forth in the appended claims.

I claim:

1. A patient's gown comprising a body portion having a yoke region and an aperture in said yoke region, said body portion, when laid out flat, being substantially rectangular and being foldable at said yoke region thereby defining a front panel and inner and outer back panels;

said front panel having first and second side edges, said inner back panel having a third side edge abutting said first side edge of said front panel when said body portion is folded at said yoke region, and said outer back panel having a fourth side edge abutting said second side edge of said front panel when said body portion is folded at said yoke region;

said inner and outer back panels each having respective center portions thereof, said center portion of said outer back panel overlapping substantially all of said center portion of said inner back panel;

whereby said patient's gown is placeable on a patient's torso with the patient's head extending through said aperture so that said front panel and inner and outer back panels substantially cover the patient's torso.

2. The patient's gown of claim 1 further comprising first fastening means disposed in cooperating relationship on said first and second side edges of said front panel, said third side edge of said inner back panel and said fourth side edge of said outer back panel, respectively, for fastening said front panel to said inner and outer back panels.

3. The patient's gown of claim 2 wherein said yoke region includes overlapping inner and outer shoulder panels, said inner shoulder panel being contiguous with said inner back panel, said outer shoulder panel being contiguous with said outer back panel.

4. The patient's gown of claim 3 further comprising second fastening means for fastening said inner and outer shoulder panels to each other, thereby securing said yoke region about said aperture.

5. The patient's gown of claim 1 wherein said body portion comprises a first piece of fabric corresponding to said front panel and at least outer portions of said inner and outer back panels, and a second piece of fabric corresponding to said center portion of one of said inner and outer back panels.

6. The patient's gown of claim 1 wherein said body portion comprises a first piece of fabric corresponding to said front panel, a second piece of fabric corresponding to said inner back panel, and a third piece of fabric corresponding to said outer back panel, said second piece of fabric joined to said first piece of fabric at a first shoulder seam and said third piece of fabric joined to said first piece of fabric at a second shoulder seam.

7. The patient's gown of claim 1 wherein said body portion comprises a first piece of fabric corresponding to said front panel and one of said inner and outer back panels and a second piece of fabric corresponding to the other of said inner and outer back panels.

8. A patient's gown comprising a body portion which, when laid out flat, is substantially rectangular, having a yoke region surrounding the patient's neck and foldable so as to drape over the patient's shoulders defining a front panel for substantially covering a front portion of the patient's torso, and first and second back panels for substantially covering a rear portion of the patient's torso;

one of said first and second back panels substantially overlapping the other of said first and second back panels at a center portion of said rear portion of the patient's torso;

said front panel having first and second side edges, said inner back panel having a third side edge abutting said first side edge of said front panel when said body portion is folded at said yoke region, and said outer back panel having a fourth side edge abutting said second side edge of said front panel when said body portion is folded at said yoke region.

9. The patient's gown of claim 8 further comprising first fastening means disposed in cooperating relationship on said first and second side edges of said front panel, said third side edge of said inner back panel and said fourth side edge of said outer back panel, respectively, for fastening said front panel to said first and second back panels along each of the patient's sides.

10. The patient's gown of claim 9 wherein said yoke region includes first and second shoulder panels, said first shoulder panel being contiguous with said first back panel and said second shoulder panel being contiguous with said second back panel such that one of said first and second shoulder panels substantially overlaps the other of said first and second shoulder panels at a center portion of the patient's shoulders.

11. The patient's gown of claim 10 further comprising second fastening means for fastening said first and second shoulder panels to each other, thereby securing said yoke region about the patient's neck.

12. The patient's gown of claim 8 wherein said body portion comprises a first piece of fabric corresponding to said front panel and at least outer portions of said first and second back panels, and a second piece of fabric corresponding to a center portion of one of said first and second back panels.

13. The patient's gown of claim 8 wherein said body portion comprises a first piece of fabric corresponding to said front panel, a second piece of fabric corresponding to said first back panel, and a third piece of fabric corresponding to said second back panel, said second piece of fabric joined to said first piece of fabric at a first shoulder seam and said third piece of fabric joined to said first piece of fabric at a second shoulder seam.

14. The patient's gown of claim 8 wherein said body portion comprises a first piece of fabric corresponding to said front panel and one of said first and second back panels and a second piece of fabric corresponding to the other of said first and second back panels.

* * * * *